US009566489B2

(12) United States Patent
De Graaf et al.

(10) Patent No.: US 9,566,489 B2
(45) Date of Patent: Feb. 14, 2017

(54) DETECTION UNIT FOR DETECTING THE OCCURRENCE OF AN EVENT A DETECTION SYSTEM AND A METHOD FOR CONTROLLING SUCH A DETECTION UNIT OR DETECTION SYSTEM

(75) Inventors: Markus Jozef De Graaf, Waalre (NL); Christiaan Joseph Jacobus Heger, Eindhoven (NL); Pepijn Rijnbout, Goirle (NL)

(73) Assignee: Technische Universiteit Eindhoven (NL)

( * ) Notice: Subject to any disclaimer, the term of this patent is extended or adjusted under 35 U.S.C. 154(b) by 243 days.

(21) Appl. No.: 13/124,185

(22) PCT Filed: Oct. 15, 2009

(86) PCT No.: PCT/NL2009/050622
§ 371 (c)(1),
(2), (4) Date: Jul. 12, 2011

(87) PCT Pub. No.: WO2010/044666
PCT Pub. Date: Apr. 22, 2010

(65) Prior Publication Data

US 2011/0257935 A1 Oct. 20, 2011

(30) Foreign Application Priority Data

Oct. 15, 2008 (NL) ..... 1036075

(51) Int. Cl.
*G06F 11/00* (2006.01)
*A63B 69/00* (2006.01)
*A63B 63/00* (2006.01)

(52) U.S. Cl.
CPC ..... *A63B 69/0053* (2013.01); *A63B 69/00* (2013.01); *A63B 63/00* (2013.01); *A63B 69/002* (2013.01);
(Continued)

(58) Field of Classification Search
CPC ..... A61B 2562/0219; A61B 5/0022; G08B 21/0446; A63B 69/0053; A63B 2207/02; A63B 2047/022; A63B 63/00; A63B 69/00
USPC ..... 702/188, 160, 141
See application file for complete search history.

(56) References Cited

U.S. PATENT DOCUMENTS 8,187,182 B2 * 5/2012 Kahn et al. ..... 600/300
2005/0167907 A1 * 8/2005 Curkendall ..... A63B 24/0021 273/108
(Continued)

FOREIGN PATENT DOCUMENTS

GB 2 332 630 A 6/1999
WO 88/05323 A 7/1988
(Continued)

OTHER PUBLICATIONS

Klomp, Henk: "Praatpaaltjes—Pylonen met LEDs leren voetballers communiceren" De Ingenieur, No. 10/11, Jul. 10, 2009, pp. 32-35 XP002560686.
(Continued)

*Primary Examiner* — Gregory J Toatley
*Assistant Examiner* — Eman Alkafawi
(74) *Attorney, Agent, or Firm* — Wood, Phillips, Katz, Clark & Mortimer

(57) ABSTRACT

The present invention relates to a detection unit comprising detection means for detecting the occurrence of an event. The detection unit further comprises processing means for controlling the operation of the detection unit and communication means for transmitting and receiving activation signals for interacting with further detection units. The processing means are designed for placing the detection unit into active mode upon receipt of an incoming activation signal, and furthermore for transmitting, in the active mode,
(Continued)

an outgoing activation signal to at least one of said further detection units upon detection of an event and placing the detection unit into passive mode. The invention further relates to a detection system comprising a multitude of detection units as described and to a method for controlling a detection unit.

13 Claims, 3 Drawing Sheets

(52) U.S. Cl.
CPC ..... *A63B 69/0024* (2013.01); *A63B 2207/02* (2013.01); *A63B 2220/801* (2013.01); *A63B 2220/805* (2013.01); *A63B 2220/808* (2013.01); *A63B 2220/833* (2013.01); *A63B 2225/54* (2013.01); *A63B 2243/00* (2013.01)

(56) References Cited

U.S. PATENT DOCUMENTS

| | | | | |
|---|---|---|---|---|
| 2007/0063850 | A1* | 3/2007 | Devaul et al. | 340/573.1 |
| 2007/0213126 | A1* | 9/2007 | Deutsch et al. | 463/36 |

FOREIGN PATENT DOCUMENTS

| | | | |
|---|---|---|---|
| WO | 90/11108 | A | 10/1990 |
| WO | 2005/004999 | A | 1/2005 |
| WO | 2005/005000 | A | 1/2005 |

OTHER PUBLICATIONS

Written Opinion for corresponding PCT/NL2009/050622.

* cited by examiner

DETECTION UNIT FOR DETECTING THE OCCURRENCE OF AN EVENT A DETECTION SYSTEM AND A METHOD FOR CONTROLLING SUCH A DETECTION UNIT OR DETECTION SYSTEM

TECHNICAL FIELD

The present invention relates to a detection unit comprising detection means for detecting the occurrence of an event, as well as to a system of such detection units, and methods for controlling the same.

BACKGROUND

During training sessions for team sports, such as hockey, soccer, water polo and the like, use can be made of various specific game situations and of appliances for training specific skills. For training ball control, for example, use can be made of cones between which a player must complete a particular course.

Certain skills, such as speed, insight into the game or communication, are difficult to train specifically, however. To acquire such skills, it is principally necessary to gain experience, which means that such skills can only be trained by playing a lot. Speed can be trained, if desired, by having the players play against a team composed of experienced, quick players, or by training on a different surface (for example indoors or on artificial grass instead of on a natural lawn. In the latter case the ball speed will increase, so that also the playing speed will have to increase. In spite of all this, no appliances are available which can be used in specifically training for speed, for example, on the usual surface.

As already mentioned before, insight into the game and strategy are likewise difficult to train. It is possible to record and explain certain situations in the game on video, so that a player will more easily recognize such situations when playing. To acquire this skill, however, it is principally necessary to gain a lot of experience.

It is an object of the present invention to provide training facilities by means of which a number of game skills, such as ball control, speed, teamwork, insight and strategy, can be specifically trained.

SUMMARY OF THE INVENTION

This object is accomplished by the present invention in that it provides a detection unit comprising detection means for detecting the occurrence of an event, processing means for controlling the operation of the detection unit, and communication means for transmitting and receiving activation signals for interacting with further detection units, wherein the processing means are designed for placing the detection unit into active mode upon receipt of an incoming activation signal, and wherein the processing means are further designed for transmitting, in the active mode, an outgoing activation signal to at least one of said further detection units upon detection of an event and placing the detection unit into passive mode.

The invention provides a detection unit by means of which the occurrence of an event can be detected, and wherein an active mode is passed to a further detection unit in response to said event. This takes place by switching the detection unit that has detected the event to passive mode and placing a next detection unit into active mode by means of an activation signal.

Examples of an event being detected are, for example, the passage of a ball in the vicinity of the detection unit or, for example, the passage of a ball through a detection gate that forms the detection unit. The invention is not limited to such events, however, the active mode can also be passed in response to alternative circumstances or events, which will be elucidated yet hereinafter. Detection of ball passage, however, is a particular embodiment which provides a large number of training possibilities. Also the passage of a player, a vehicle or other object may be considered, of course. It is also possible to design the detection unit to be responsive to the occurrence of more than one event. In this connection the option may be considered that, in addition to the passage of a ball through a gate, also the expiry of a time limit will result in the active mode being passed, or that an external control signal (for example provided by a trainer) will result in the active mode being passed.

With the system described herein, a player to be trained can be directed into a field provided with gates with a ball during soccer training, with the instruction to play the ball through a different gate each time. In the simplest embodiment, the activation signal can be sent to a random further detection unit, so that the player does not know beforehand which gate will be activated and through which gate the ball must be played.

In a preferred embodiment, the selection of a further detection unit, a destination detection unit, to which the activation signal is transmitted can also be done on the basis of selection rules. This provides a great many possibilities. Thus it is possible, for example, to activate a number of gates in a specific sequence or, for example, to set preferences for specific detection units as regards the selection of specific further detection units.

More in particular, the following selection rules may be considered, for example:

- the detection unit will at all times select the same destination detection unit;
- the detection unit will select a destination unit from a fixed sub-group of destination units;
- the detection unit will select a destination detection unit which has not been active yet or which has not been active for some (consecutive) time;
- the detection unit will select a destination detection unit in dependence on the period of time during which the detection unit has been active; or
- the detection unit will select a destination detection unit in dependence on, for example, the player.

Those skilled in the art will realise that the number and the form of the selection rule have been freely selected and that the above examples are merely exemplary embodiments which must not be construed as being limitative to the invention.

It should furthermore be noted that the selection rules may be different for each detection unit in the game. Thus it is possible that some of the detection units will randomly select a destination detection unit for passing the active mode thereto, whilst one or more other detection units make use of selection rules.

Selection rules can also be applied in such a manner that at least one destination selection unit is determined on the basis of the selection rules. Upon detection of the event that triggers the transmission of an outgoing activation signal, one (or more) destination detection units can be selected at random from the selected units, for example.

The detection unit may furthermore have a stand-by mode, by which the detection unit can indicate that it has been elected to be the destination detection unit (or one of the destination detection units) that will (possibly) be activated upon transmission of the outgoing activation signal. In this way a feed forward system is created, in which the player/user can already anticipate future game situations.

The above embodiment is in fact a special implementation of the more general embodiment, in which the detection unit has more than one possible active mode, and in which the detection unit is placed into a specific desired active mode on the basis of the content of the received activation signal. In this embodiment it is possible, among other things, to have several different active modes participate simultaneously in the game, for example for different teams of players. The detection unit can pass said desired active mode to a further detection unit upon occurrence of the event that triggers the transmission of an outgoing activation signal.

According to one embodiment, the processing means are designed for recognizing incoming activation signals intended for the detection unit, which are to place the detection unit into active mode. In this way the detection unit is capable of recognising whether a specific activation signal is intended for itself. Recognition can take place on the basis of an identification code.

The processing means of the detection unit may also be designed for transmitting identification signals via the communication means for the purpose of identifying said detection unit to the further detection units. This makes it possible to make the participation of the detection unit in question known to each of the other detection units that participate in the game. In this way a detection unit can be added and activated in a simple manner during the game, so that the added detection unit will automatically participate in the game. It is also possible to remove detection units during the game.

The transmission of identification signals can as standard take place upon activation of the detection unit. The transmission of identification signals may also take place in response to the reception of a specific other signal, for example a request signal from a further detection unit, as will be described in more detail yet hereinafter.

In another embodiment, the processing means of the detection unit are designed to transmit, in the active mode, an outgoing request signal upon detection of the event. By means of said request signal, the detection unit inquires which other detection units are available for "taking over" the active mode. In response thereto, other detection units can send a confirmation. Said confirmation may comprise the identification signal.

As already described before, the processing means may also be designed to select a destination detection unit from said further detection units for transmitting the outgoing activation signal thereto. The advantage of this embodiment is that specific game situations or training possibilities can be provided by means of said detection unit. Thus it is possible to plot a course on a sports field by means of the detection units, with a player having to play the ball through the respective active detection gates. Another advantage of this embodiment is that it becomes possible for the trainer to include a specific difficult direction change or distances that are difficult to bridge in the training session. The trainer can for example programme the detection units so that a specific detection unit, upon detecting a ball passage while in active mode, will automatically select a specific further detection unit that is difficult to reach for transmitting the activation signal thereto. Selection takes place by means of a preset selection rule in that case.

The detection means in the detection unit may comprise at least one element from a group comprising means for detecting physical contact between an object and the detection means, means for detecting physical contact between a multitude of objects, as in the case of a change in the possession of a game object between players during a game, touch-sensitive sensors, capacitive sensors, sound sensors, light sensors, means for detecting electromagnetic radiation, vibration sensors and means for detecting electromagnetic signals, such as radio-frequency identification signals (RFID).

The detection means may also comprise direction-sensitive motion sensors, by means of which it is possible to detect not only the passage of an object, such as a ball, a player or a vehicle, but also the direction thereof. In this way the possibilities for using the detection unit during sports training sessions are strongly enhanced. Furthermore it is currently possible to use pattern recognition, so that a sound pattern or a light pattern, for example, can be recognised by means of the detection means. Thus it becomes possible to detect specific players individually on the field via detection means. It is also possible to identify the player on the basis of, for example, received footstep sounds. It stands to reason that the detection means must in that case be designed for analysing specific physical quantities in addition to detecting said quantities. It is further possible to use several detection means or sensors, such as combinations of the aforesaid detection means, for example, for enabling more complex forms of detection.

In the foregoing it has already been described that it is possible, for example, to provide detection gates that detect ball passage. It is also possible to provide the detection means with touch-sensitive sensors, which register whether there has been contact between an object (for example a ball) and the detection unit. It is also possible, for example, to incorporate sound sensors in the detection means so as to make it possible, for example, to detect whether the trainer is blowing his whistle. The trainer can in that case activate another gate by whistling. The advantages achieved in this way can also be achieved by providing the detection means with light sensors, for example, in which case the trainer can influence the detection units by means of a light signal (such as an infrared signal), or means for receiving electromagnetic signals, which can interact with the communication means, for example. In the latter case, the trainer will be able to influence the operation of the detection units in the field via a remote control unit. Possibly, a detection unit will in that case only react when the remote control unit is located sufficiently close to the detection unit.

According to a second aspect, the invention provides a detection system comprising one or more detection units as described above.

A detection system consisting of several detection units according to the invention provides several training possibilities during a training session, or playing possibilities for playing in the street. In use, such a system will pass an active mode from gate to gate from a starting situation, a player's task being to cause the event that results in the active mode being passed to take place (in time, if desired). Thus, the individual hockey player can be directed through the field via a number of gates within the framework of practising ball control. Furthermore it is possible to line up a team of players to be trained between the gates in the field and train combinations between the various players by making use of the detection system. The ball must in that case be played to the player who is in an advantageous position at that point in time for playing to the active gate, for example. If the detection units are used during skating practice in the street, for example, the detection units can be used for plotting a slalom course. In a standard embodiment, the starting situation will consist of a multitude of passive detection units and one detection unit in active mode, which active mode can be passed between the detection units in that case.

In another embodiment, several detection units may be in active mode in the starting situation, for example, which active mode is passed from unit to unit. In yet another embodiment, new active modes may be created (at random) during the game. On the other hand, active modes may (spontaneously) disappear during the game. It is even possible that for some time during the game not a single detection unit will be active, think in this connection of the possibility that a regular match is played during the training session, and that suddenly a detection unit becomes active, so that the regular game must be interrupted and the detection unit must be played. In such a case the trainer can train the team regarding the occurrence of unexpected events during a match and possible ways of reacting thereto. The quickness of response of a team can thus be enhanced, for example.

The starting situation of the detection system can be made to be adjustable inter alia by means of a control unit in the detection system. With such a control unit, the operating conditions can be preset or be influenced during the game. The operating conditions may for example form part of a group comprising the number of simultaneous active modes in the system, a maximum duration of an active mode of a detection unit, colour indications associated with specific active modes, the manner of passing an active mode by means of activation signals, whether or not by making use of feed-forward, etc.

According to a third aspect, the invention provides a method for controlling a detection unit as described above, comprising the steps of: placing the detection unit from passive mode into active mode upon receipt of an incoming activation signal; detecting, in the active mode, the occurrence of an event via detection means; and, upon detection of an event, transmitting an outgoing activation signal to at least one further detection unit and placing the detection unit into passive mode.

In the passive mode, the detection unit only waits for the reception of an activation signal. Once an activation signal has been received, for example a signal intended for the detection unit, the detection unit will switch to active mode, in which it awaits the detection of an event. Upon detection of the event, for example the passage of a ball, or the elapse of a predetermined period of time, an outgoing signal will be transmitted, and the detection unit will return to passive mode.

The passing of the active mode can take place by sending a request signal upon detection of the event and wait for a response from other detection units which are available for "receiving" the active mode. The detection unit can then select a further detection unit from the available detection units and transmit the activation signal to the intended detection unit. After a brief handshake, for example, which is not mandatory, the transmitting detection unit can switch itself to the passive mode.

Selection rules may be introduced for selecting the desired detection unit. Such selection rules make a system of detection units appear to have a certain intelligence based on the selected selection rules.

The events that can be detected by means of the detection units according to the present invention may have been selected from a group comprising the exceeding of a time limit, the passage of an object in the vicinity of the detection unit, contact between an object and the detection unit, reception of a control signal (for example from a trainer), such as an electromagnetic control signal, a sound signal or a light signal. The invention is not limited to these events, however. If the detection unit responds to the exceeding of a time limit, the time limit may be automatically adapted by the detection unit during the course of the game, in dependence on, for example, the player's performance. The detection unit can thus adapt itself to the situation in the game.

According to a fourth aspect, the invention provides a method for controlling a detection system as described above, which consists of detection units according to the invention.

BRIEF DESCRIPTION OF THE DRAWING

The invention will now be described in more detail on the basis of a few, non-limitative, specific embodiments thereof with reference to the appended drawings, in which.

DETAILED DESCRIPTION OF THE DRAWING

Figure 1:
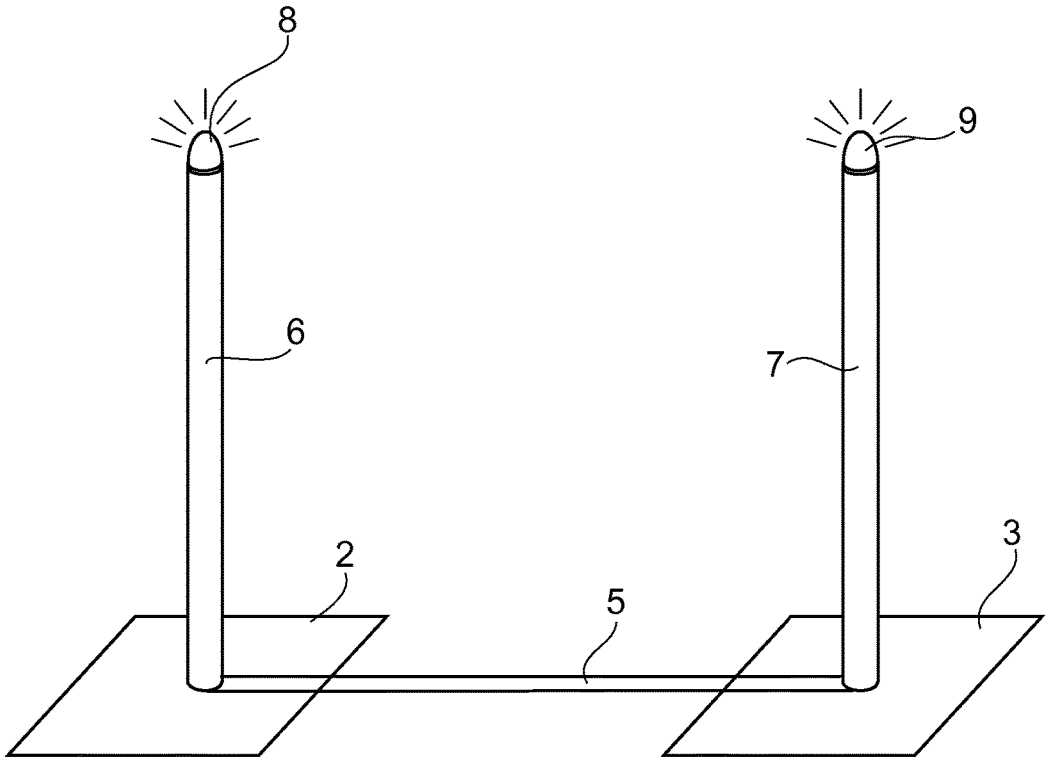
FIG. 1 shows a detection unit according to the present invention.

FIG. 1 schematically shows a detection unit according to the present invention (generally indicated at 1). The detection unit comprises two parts, part 2 and part 3, which are each provided with an identifiable post 6, 7. Located between said parts 2 and 3 is a sensor part 5, which is capable of detecting the passage of, for example, the ball between the posts 6 and 7. The detection unit is further provided with indication lighting 8 and 9, which functions to indicate to a player that the detection unit in question is active.

The invention is not limited to sound and/or light signals for indicating the active mode. Other ways of indication, for example by means of vibrations, heat, movements of parts, or (wireless) communication to a module worn by a player are also possible.

Figure 2:
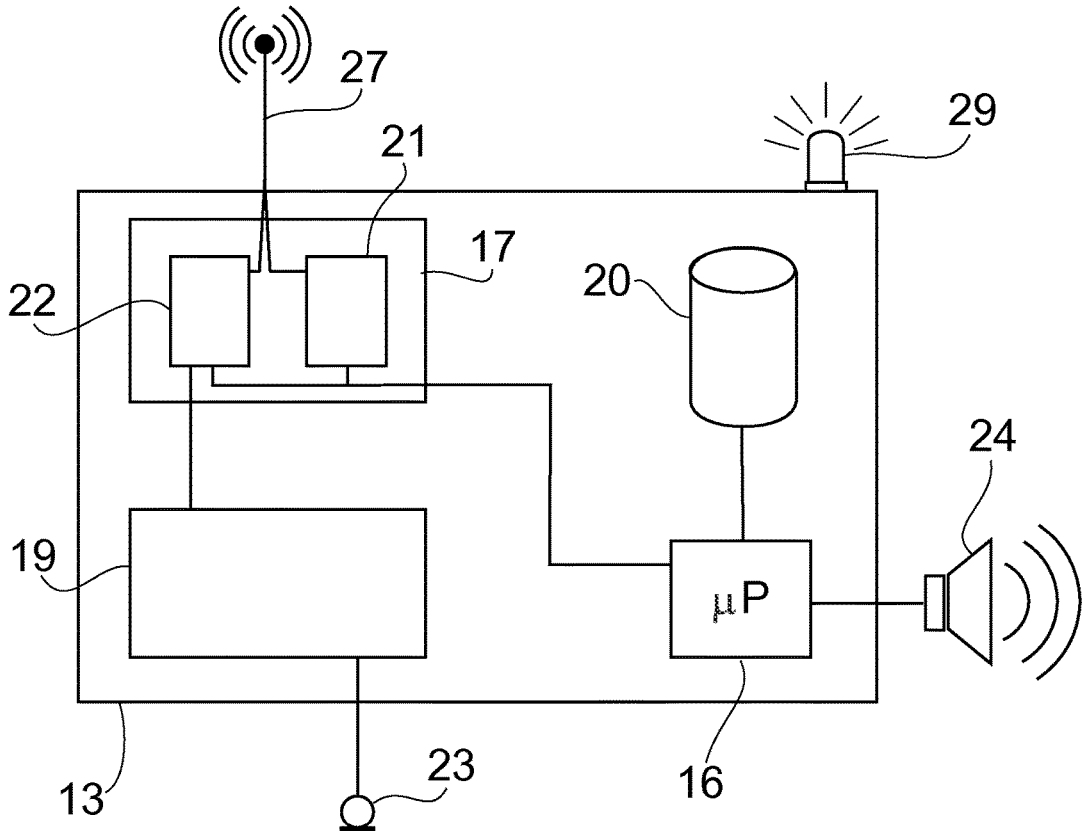
FIG. 2 is a schematic view of a detection unit according to the present invention.

One embodiment of the detection unit is schematically shown in FIG. 2. FIG. 2 shows the detection unit 13, which comprises a microprocessing unit 16, which controls the various parts of the detection unit 13. The microprocessing unit 16 is connected to communication means 17, detection means 19 and an internal memory 20. The communication means 17 comprise transmitter means 21 and receiver means 22, which are connected to an antenna 27. The detection means 19 may furthermore be connected to, for example, a microphone 23 for detecting sound signals or to receiver means 22 for detecting control signals that may be delivered by a trainer for influencing the operation of the detection unit by means of a remote control unit. The microprocessing unit 16 is furthermore connected to an indication lighting unit 29, by means of which the active or passive mode can be indicated (lighting on means "active" and lighting of means "passive", or conversely, if desired). The microprocessing unit 16 may furthermore be connected to a loudspeaker 24 for producing sound signals, if this should be desired. Other indication means are also possible, for example a display screen (for example alphanumeric) or different lighting colours.

The detection means may be provided with capacitive sensors, sensors for detecting electric, magnetic or electromagnetic fields, vibration sensors, optical sensors, motion sensors and the like, by means of which the occurrence of events can be detected. Thus, FIG. 1 shows a detection gate, but a detection unit may also be configured as a goal plate, against which a ball is to be shot. The detection unit is in that case provided with, for example, a vibration sensor.

The operation of the unit 13 is as follows. The unit 13 is as standard in passive mode upon being switched on. The detection unit 13 will be distributed over a playing field together with a multitude of similar detection units. When the detection units are switched on, an identification signal may optionally be transmitted by each of the detection units, which signal can be picked up by each of the other detection units. On the basis of identification signals received via the antenna 27 and the receiver means 22, the microprocessing unit 13 in the detection unit 13 can store in the memory 20 which detection units are located in the vicinity and are switched on (and thus take part in the game).

The trainer can switch one of the detection units to active mode, for example by pressing a button on one of the detection units or by transmitting a starting signal. In active mode, the microprocessing unit will wait for a signal from the detection means, which shows that a specific event has occurred. This may be the passage of a ball, the occurrence of a control signal (for example a whistle-signal from a trainer or an electromagnetic control signal transmitted by means of a remote control unit), for example, or another event to be measured. When the occurrence of an event is detected by the detection means 19, a signal will be transmitted to the microprocessing unit 16, and a destination detection unit will be selected by the microprocessing unit 16 from the available detection units whose identification codes are stored in the internal memory 20, for example. The selection of a destination detection unit can take place at random from the available detection units, but it is also possible for the microprocessing unit 16 to apply selection rules. Said selection rules may also be stored in the internal memory 20. The selection rules may for example be aimed at selecting preferably one specific detection unit in relation to the detection unit 13, so that each time a detection unit 13 has been active, the active mode is "passed" to a further detection unit which is present at a location on the playing field that is difficult to reach from the detection unit 13. Furthermore, the selection rules may be aimed at selecting detection units from a subgroup of available detection units. Selection rules can be freely set by the user. If more than one selection rule is set, the rules may be prioritized in relation to each other.

Once a destination detection unit has been selected by the microprocessing unit 16, the microprocessing unit 16 will transmit an activation signal to the destination detection unit via the transmitter means 21 and the antenna 27. The microprocessing unit 16 will also switch the detection unit 13 to passive mode, switching off the indication lighting 29 to indicate to the player that the detection unit is no longer in active mode. If possible, the microprocessing unit 16 can deliver a sound signal via the loudspeaker 24.

Figure 3:
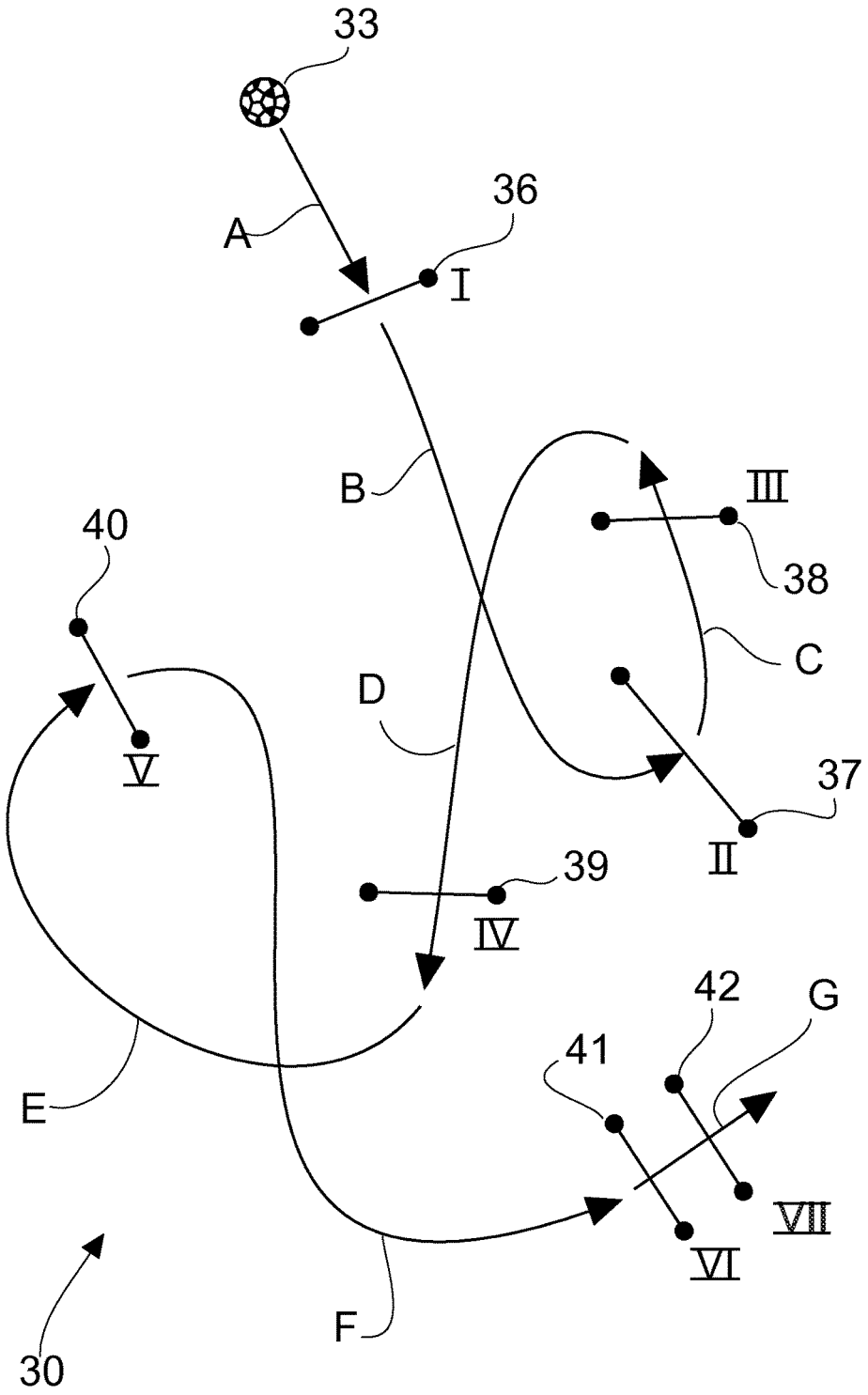
FIG. 3 is a schematic illustration of a situation in the game in which a detection system according to the present invention is used.

FIG. 3 shows a possible game situation, in which the present invention is used. FIG. 3 is a schematic representation of a playing field, in which numerals I-VII indicate the sequence in which the detection units are switched to active mode. In other words, a selection rule is implemented in detection unit 36 to select preferably detection unit 37 from an active mode. Detection unit 37 has an implemented selection rule to select detection unit 38 as the destination detection unit. In detection unit 38, detection unit 39 is preferably to be selected from the active mode, and detection unit 39 has an implemented selection rule to "pass" the active mode from this detection unit to detection unit 40. Detection unit 40 has an implemented selection rule to select detection unit 41, and detection unit 41 uses an implemented selection rule to preferably select detection unit 42 from this detection unit.

In an alternative embodiment, no selection rules are implemented in the detection units, and the active mode is passed to a randomly selected further detection unit 36-42 in the playing field upon detection of an event.

The training session is started by placing the detection unit 36 into active mode. This can be done by means of a control button on the detection unit or, for example, by means of a remote control unit. Those skilled in the art will appreciate that there other possibilities are available for placing the detection unit 36 into active mode, for example by making use of the detection means in the detection unit. Thus, a detection unit can be forced into active mode, if desired, by causing the occurrence of an event to be detected one or more times. The player to be trained is schematically indicated by the football 33.

Since detection gate 36 is active, player 33 will have to play the ball through the detection gate 36 in step A. Upon detecting this event, the detection gate 36 will transmit an activation signal to the detection unit 37, which has been selected on the basis of selection rule 36, so that the active mode is passed to detection gate 37 (indicated II in the sequence). The detection unit 36 will then switch to passive mode. The detection unit 37 will subsequently be in active mode. The player 33 will then play the ball to detection gate 37 in step B, which gate, upon detecting this event, will "pass" the active mode to detection unit 38. In this way the player 33 will play the ball through detection gates 36, 37, 38, 39, 40, 41 and 42 in steps A, B, C, D, E, F and G.

Noticeable is the fact that by arranging the detection gates 41 and 42, which take up positions VI and VII in the sequence, right after one another, the player is forced to play the ball through the gates 41 and 42 in the direction indicated in step G. A trainer can utilise this, for example when specific difficult direction changes or situations must be trained. In an alternative embodiment, the detection means may also be arranged for detecting not only passage of the ball but also the direction in which said passage takes place. This can for example be achieved by providing the detection unit with two suitable sensors for detection the passage of a ball past two locations, for example two motion sensors.

In the example shown in FIG. 3 and described above, the active mode is passed by the detection units 36-42 upon detecting the passage of a ball through the detection gates. The player 33 can complete the course at his own pace. If the trainer also wants to train speed, he has the option of setting the detection units 36-42 so that the detection means will also detect the elapse of a predetermined period of time. The processing means will in that case send an activation signal to the next detection unit either when the ball has been played through the detection unit or when the predetermined period has elapsed. In this case, the player only has a predetermined period of time for playing from gate to gate and completing the entire course. If the player does not succeed in completing step D from detection unit 38 to detection unit 39 within the set period of time, the detection unit 39 will switch to passive mode again and send the activation signal to the detection unit 40, so that the play must change direction halfway step D, for example, and play the ball through the detection unit 40 for completing the rest of the course.

A detection system according to the invention consisting of several detection units operates according to the decentralization principle. That is, each detection unit functions independently and in principle there is no need for a central control unit (for example a computer) which decides on mode changes of detection units. Certain embodiments of the system may be provided with a central unit by means of which the operation parameters can be set, but the operation of the system is not dependent on the presence of such central unit. Central control is optional for the system, but not essential. It facilitates control thereof.

The invention is not limited to the above-described embodiments, those skilled in the art will appreciate that the inventive principle described in the foregoing can also be modified in ways that will be obvious. The scope of the invention is limited only by the appended claims.

The invention claimed is:

1. A detection unit comprising detection means for detecting the occurrence of an event, processing means for controlling the operation of the detection unit, and communication means for transmitting and receiving activation signals for interacting with further detection units, wherein the processing means are designed for placing the detection unit into active mode upon receipt of an incoming activation signal, wherein said detection unit operates in a decentralized system, and an active mode of said detection unit is indicated with at least one of sound, light signals, vibrations, heat, movements of parts, and communication to a module worn by a player, and in that detection unit is arranged for selecting, randomly or making use of selection rules, a destination detection unit for passing the active mode thereto, and the processing means are further designed for transmitting, in the active mode, an outgoing activation signal to at least one of said further detection units upon detection of an event for switching said at least one of said further detection units to active mode, and placing the detection unit into passive mode.

2. A detection unit according to claim 1, wherein the processing means are designed for recognizing incoming activation signals intended for the detection unit, which are to place the detection unit into active mode.

3. A detection unit according to claim 1, wherein the processing means are designed for transmitting identification signals via the communication means for the purpose of identifying said detection unit to the further detection units.

4. A detection unit according claim 1, further comprising memory means for storing identification data from received identification signals.

5. A detection unit according to claim 1, wherein the processing means of the detection unit are designed to transmit, in the active mode, an outgoing request signal upon detection of the event.

6. A detection unit according to claim 1, in which the processing means are designed to select at least one destination detection unit from said further detection units as said destination detection unit for transmitting the outgoing activation signal thereto.

7. A detection unit according to claim 6, in which the processing means are designed to select the at least one destination detection unit on the basis of at least one selection rule.

8. A detection unit according to claim 1, in which the detection means comprise at least one element from a group comprising means for detecting the distance from an object to detection means, in response to passage of an object through a detection gate, means for detecting physical contact between an object and the detection means, means for detecting physical contact between a multitude of objects, as in the case of a change in the possession of a game object between players during a game, touch-sensitive sensors, capacitive sensors, sound sensors, light sensors: means for detecting electromagnetic radiation, vibration sensors, means for detecting electromagnetic signals, and means for detecting time, motion sensors, direction-sensitive motion sensors, light sensors: image sensors or sound pattern recognition sensors, or combinations of several detection means from this group.

9. A detection unit according to claim 1, in which the processing means are designed for examining an incoming activation signal upon receipt thereof and placing the detection unit into one desired active mode in dependence on a content of said activation signal, said one desired active mode being selected from a group of a multitude of active modes.

10. A detection unit according to claim 9, in which the processing means are further designed for providing the outgoing activation signal with data for the activation of the desired active mode being selected from said group of a multitude of active modes of said destination detection unit.

11. A detection unit according to claim 9, in which the available active modes comprise a standby mode, in which the processing unit is designed for transmitting, after said destination detection unit has been selected, an outgoing feed forward activation signal for placing said at least one destination detection unit into standby mode.

12. A detection system comprising one or more detection units according to claim 1.

13. A detection system according to claim 12: further comprising a control unit for setting the operating conditions of the detection system.

* * * * *